US007481325B2

(12) United States Patent
Simpson, Jr. et al.

(10) Patent No.: US 7,481,325 B2
(45) **Date of Patent: *Jan. 27, 2009**

(54) MOLDED PLASTIC CONTAINER HAVING HOT-FILL PANELS

(75) Inventors: Charles P Simpson, Jr., Adrian, MI (US); Stephen R Guerin, Milford, NH (US); David P Piccioli, Auburn, NH (US); Qiuchen Peter Zhang, Perrysburg, OH (US)

(73) Assignee: Graham Packaging PET Technologies Inc., York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/485,228

(22) Filed: Jul. 12, 2006

(65) Prior Publication Data

US 2006/0249477 A1 Nov. 9, 2006

Related U.S. Application Data

(63) Continuation of application No. 10/643,217, filed on Aug. 14, 2003, now Pat. No. 7,097,061.

(51) Int. Cl.
*B65D 23/10* (2006.01)
*B65D 1/02* (2006.01)
*B65D 1/42* (2006.01)

(52) U.S. Cl. ..... 215/384; 215/373; 215/397

(58) Field of Classification Search ..... 215/49, 215/42–44, 373, 381, 384, 386, 396, 398; 220/288, 608, 666, 669, 671, 675, 769–771; 294/27.1, 31.2, 33
See application file for complete search history.

(56) References Cited

U.S. PATENT DOCUMENTS 1,636,174 A 7/1927 Dolan et al.
D187,398 S 3/1960 Vanderhyde (Continued)

FOREIGN PATENT DOCUMENTS

WO WO 91/06484 * 5/1991

(Continued)

*Primary Examiner*—Sue A Weaver
(74) *Attorney, Agent, or Firm*—Rissman Jobse Hendricks & Oliverio, LLP

(57) ABSTRACT

A container includes a hollow body having a finish extending from the body. The finish has an open end, at least one external thread for securement of a closure, and a pair of spaced external circumferential flanges on a side of the thread remote from the open end of the finish. A bale handle includes a ring having resilient internal tabs captured beneath the lower of the flanges remote from the open end of the finish, and a handle extending from the ring for carrying the container. The upper flange, which preferably has a greater outside diameter than the lower flange, has an undersurface that is free of obstruction from the bale handle and therefore is adapted to perform support functions for the container after attachment of the bale handle to the container finish.

15 Claims, 4 Drawing Sheets

U.S. PATENT DOCUMENTS

D198,404 S 6/1964 Busch
D203,884 S 2/1966 Wood
3,323,668 A 6/1967 Hills
D209,018 S 10/1967 Holtz
3,403,804 A 10/1968 Colombo
3,463,536 A 8/1969 Updegraff et al.
3,468,443 A 9/1969 Marcus
3,733,309 A 5/1973 Wyeth et al.
D231,904 S 6/1974 Boden
D240,800 S 8/1976 Jespersen
D258,117 S 2/1981 Bashour
D262,267 S 12/1981 Cox
4,308,955 A 1/1982 Schieser et al.
D277,551 S 2/1985 Kerr
4,497,855 A 2/1985 Agrawal et al.
D279,167 S 6/1985 Haney et al.
4,520,936 A 6/1985 Lyons
D281,577 S 12/1985 Larson et al.
4,722,451 A 2/1988 Conrad
4,750,629 A 6/1988 Young
4,804,097 A 2/1989 Alberghini et al.
4,863,046 A 9/1989 Collette et al.
4,881,650 A 11/1989 Bartz
4,890,752 A 1/1990 Ota et al.
4,909,403 A * 3/1990 Reyes ..... 215/398
4,923,073 A * 5/1990 Wilde ..... 215/252
D318,798 S 8/1991 Biesecker
5,054,632 A 10/1991 Alberghini et al.
5,067,622 A 11/1991 Garver et al.
5,092,475 A 3/1992 Krishnakumar et al.
5,104,706 A 4/1992 Krishnakumar et al.
5,133,468 A 7/1992 Brunson et al.
5,141,120 A 8/1992 Brown et al.
5,141,121 A 8/1992 Brown et al.
5,178,289 A 1/1993 Krishnakumar et al.
5,279,433 A 1/1994 Krishnakumar et al.
D344,457 S 2/1994 Prevot et al.
5,303,834 A 4/1994 Krishnakumar et al.
5,337,909 A 8/1994 Vailliencourt
5,341,946 A 8/1994 Vailliencourt et al.
5,472,105 A 12/1995 Krishnakumar et al.
5,503,283 A 4/1996 Semersky
5,507,402 A * 4/1996 Clark ..... 215/375
5,598,941 A 2/1997 Semersky et al.
5,637,167 A 6/1997 Krishnakumar et al.
5,642,826 A 7/1997 Melrose
5,676,267 A 10/1997 Slat et al.
5,678,711 A 10/1997 Tobias
5,704,503 A 1/1998 Krishnakumar et al.
5,728,347 A 3/1998 Collette et al.
5,759,653 A 6/1998 Collette et al.
5,763,030 A 6/1998 Matsui
5,780,130 A 7/1998 Hansen et al.
5,829,614 A 11/1998 Collette et al.
5,884,792 A 3/1999 Krishnakumar et al.
5,908,127 A 6/1999 Weick et al.
5,918,754 A 7/1999 Lyons et al.
5,927,525 A 7/1999 Darr et al.
5,971,184 A 10/1999 Krishnakumar et al.
5,989,661 A 11/1999 Krishnakumar et al.
6,016,932 A 1/2000 Gaydosh et al.
6,036,037 A 3/2000 Scheffer et al.
6,044,997 A 4/2000 Ogg
6,062,409 A 5/2000 Eberle
6,090,460 A 7/2000 Collette et al.
6,112,925 A 9/2000 Nahill et al.
6,213,326 B1 4/2001 Denner et al.
6,257,433 B1 4/2001 Ogg et al.
6,223,920 B1 5/2001 Lane et al.
6,230,912 B1 5/2001 Rashid
6,273,282 B1 * 8/2001 Ogg et al. ..... 215/381
6,296,131 B2 10/2001 Rashid
6,347,717 B1 2/2002 Eberle
6,349,839 B1 2/2002 Mooney
6,372,318 B1 4/2002 Collette et al.
6,375,025 B1 4/2002 Mooney
6,390,316 B1 5/2002 Mooney
6,394,517 B1 * 5/2002 Borg ..... 294/31.2
6,398,052 B1 6/2002 Cheng et al.
6,439,413 B1 8/2002 Prevot et al.
6,467,639 B2 10/2002 Mooney
6,585,125 B1 7/2003 Peek
6,662,961 B2 * 12/2003 Yourist ..... 215/382
D508,410 S * 8/2005 Zboch et al. ..... D9/667
D509,984 S * 9/2005 Zboch et al. ..... D9/667
7,097,061 B2 * 8/2006 Simpson et al. ..... 215/396
2001/0054597 A1 * 12/2001 Ozawa et al. ..... 215/381
2003/0000912 A1 1/2003 Deubel et al.

FOREIGN PATENT DOCUMENTS

WO WO 99/52701 * 10/1999
WO WO 99/57021 11/1999

* cited by examiner

MOLDED PLASTIC CONTAINER HAVING HOT-FILL PANELS

This application is a continuation of and claims priority to U.S. Ser. No. 10/643,217, filed Aug. 14, 2003, the contents of which is incorporated herein in its entirety.

The present invention is directed to molded plastic containers, and more particularly to a one-gallon hot-fill molded plastic container having a bale handle assembled to the container finish.

BACKGROUND AND SUMMARY OF THE INVENTION

In so-called hot-fill packages, a container is filled with hot liquid product and capped while the liquid product is still hot. As the liquid cools, the reduction in liquid volume creates a vacuum within the package—i.e., an internal pressure that is less than the surrounding atmospheric pressure. When the container is of molded plastic construction, the container wall tends to distort inwardly as the liquid cools. This problem is exacerbated when the container is relatively large and/or has flat walls. It has been proposed to provide ribs or channels on the container walls to strengthen the walls against distortion, and to provide vacuum panel areas on the container walls for controlling the areas of distortion under vacuum. These measures have not been entirely effective in containers of larger size. Hot-fill containers of relatively large capacity, such as one-gallon containers, typically are of cylindrical wall construction to take advantage of the inherent strength of a cylindrical wall geometry and to avoid the use of large flat wall panel areas at which distortion can occur.

Another problem in the art, as applied particularly to containers of larger size, involves attachment of bale handles to the container finish to facilitate carrying of the filled container by a consumer. Molded plastic containers typically have a flange that extends circumferentially around the container finish. This flange, often referred to as a capping flange or a support flange, serves a variety of support functions during automated fabrication and handling of the container. Attachment of a bale handle to the container finish beneath the flange obstructs the area beneath the flange and makes these support functions more difficult during container filling and capping, for example.

The present invention involves a number of different aspects that may be implemented separately from or, more preferably, in combination with each other.

A container in accordance with a first aspect of the present invention includes a hollow body having a finish extending from the body. The finish has an open end, at least one external thread for securement of a closure, and a pair of spaced external circumferential flanges on a side of the thread remote from the open end of the finish. A bale handle includes a ring having resilient internal tabs captured beneath the lower of the flanges remote from the open end of the finish, and a handle extending from the ring for carrying the container. The upper flange, which preferably has a greater outside diameter than the lower flange, has an undersurface that is free of obstruction from the bale handle and therefore is adapted to perform support functions for the container after attachment of the bale handle to the container finish.

A one-gallon rectangular hot-fill container in accordance with a second aspect of the invention includes a rectangular body having a front wall, a back wall and opposed sidewalls, a bottom wall with a central push-up feature, an externally threaded finish and a shoulder connecting the finish to the body. The sidewalls have recessed handle areas adjacent to the back wall and flexible hot-fill panels adjacent to the front wall. The back wall has strengthening channels that extend between the handle areas. The front wall has strengthening channels that extend between and into the sidewalls. The body has a pair of spaced channels that extend entirely around the body between the sidewalls, front wall and back wall, and the bottom wall and the shoulder respectively. One of the channels on the front wall extends into the sidewalls between the hot-fill panels on the sidewalls. The rectangular container is specifically adapted for hot-fill applications with minimum wall distortion, and the rectangular geometry of the container body lends itself to close-packing on store shelves with minimum wasted shelf area.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 1:
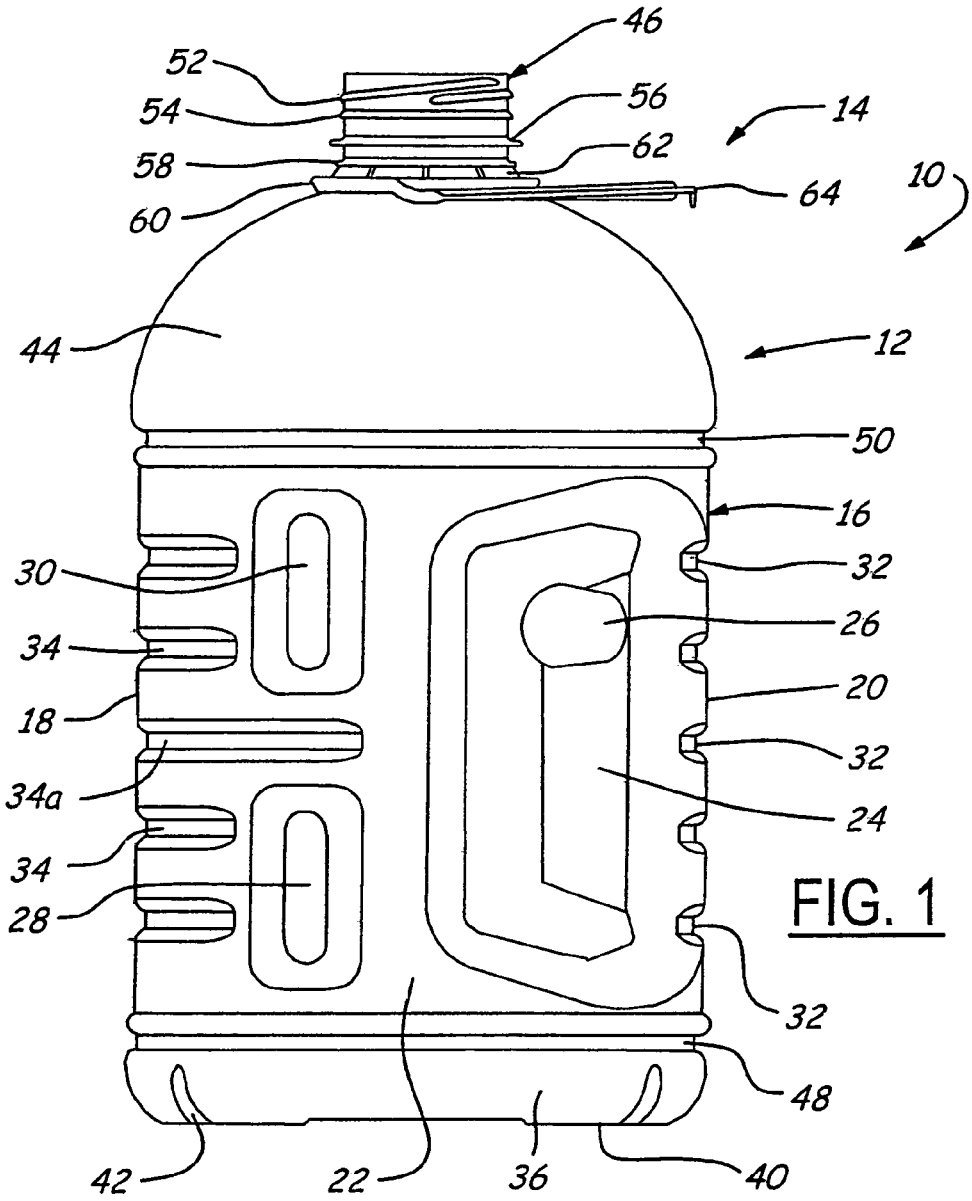
FIG. 1 is a side elevational view of a container in accordance with one presently preferred embodiment of the invention.

FIG. 1 illustrates a container and handle assembly 10 in accordance with one presently preferred embodiment of the invention as including a container 12 having a bale handle 14 secured thereto. Container 12 is of one-piece integrally molded plastic construction, such as polyethylene terephthalate (PET). Container 12 includes a generally rectangular body 16 having a front wall 18, a back wall 20 and laterally opposed sidewalls 22. Sidewalls 22, which are mirror images of each other, have opposed generally trapezoidal recessed handle areas 24 adjacent to and intersecting back wall 20. Each recessed handle area 24 includes a recessed thumb area 26 to facilitate grasping of the container for pouring. A pair of axially spaced vacuum panels 28, 30 are provided on each sidewall 22 between handle area 24 and front wall 18. (Directional words such as "axial" and "lateral" are used by way of description and not limitation with respect to the axis of the container finish, which is concentric with the central axis of body 16 in the preferred embodiments of the invention.) An axially spaced array of laterally extending strengthening channels 32 are provided on back wall 20 between recessed handle areas 24. Likewise, an array of axially spaced laterally extending strengthening channels 34 are provided on front wall 18. Channels 34 extend around the corner of front wall 18 into sidewalls 22. One of the channels 34*a* is elongated, as best seen in FIG. 1, and extends between vacuum panels 28, 30 on each sidewall 22.

Figure 4:
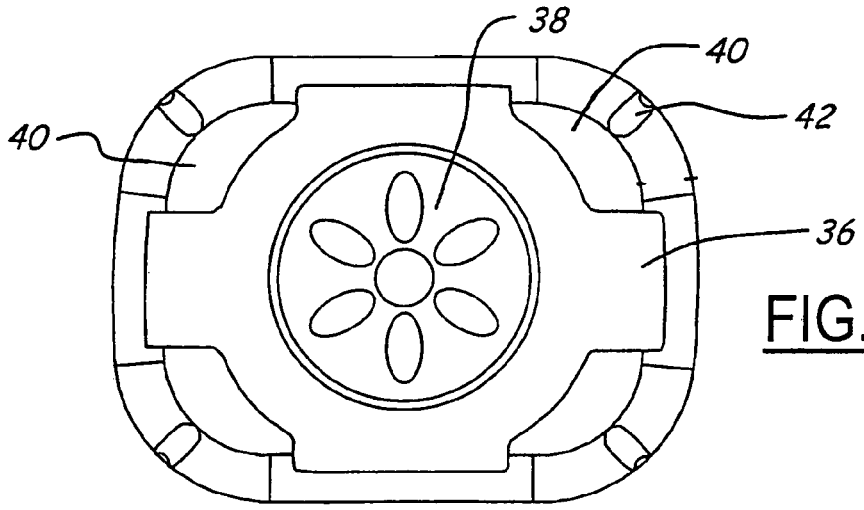
FIG. 4 is a bottom plan view of the container in FIG. 1.
Figure 2:
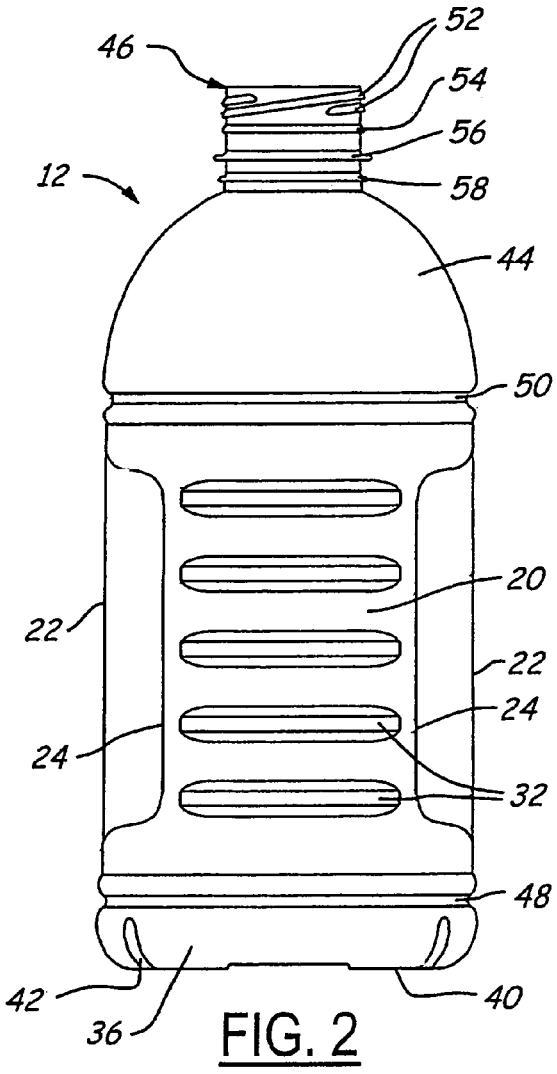
FIG. 2 is a rear elevational view of the container illustrated in FIG. 1 minus the bale handle.
Figure 3:
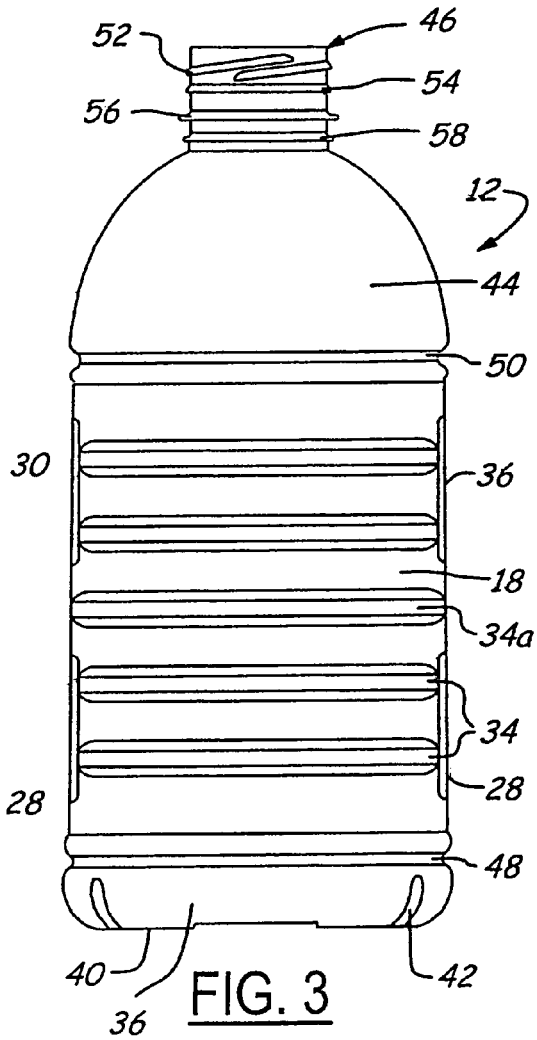
FIG. 3 is a front elevational view of the container in FIG. 1 without the bale handle.

Container 12 also includes a bottom wall 36 having a central push-up feature 38 (FIG. 4) for strengthening the bottom wall under vacuum. Bottom wall 36 has an axially extending foot 40 at each corner, with a strengthening channel 42 bisecting each foot 40. A shoulder 44 extends upwardly from body 16 to a container finish 46. Body 16 is isolated from bottom wall 36 and shoulder 44 by a pair of channels 48, 50 that extend entirely around the container body in planes parallel to the axis of finish 46.

Figure 5:
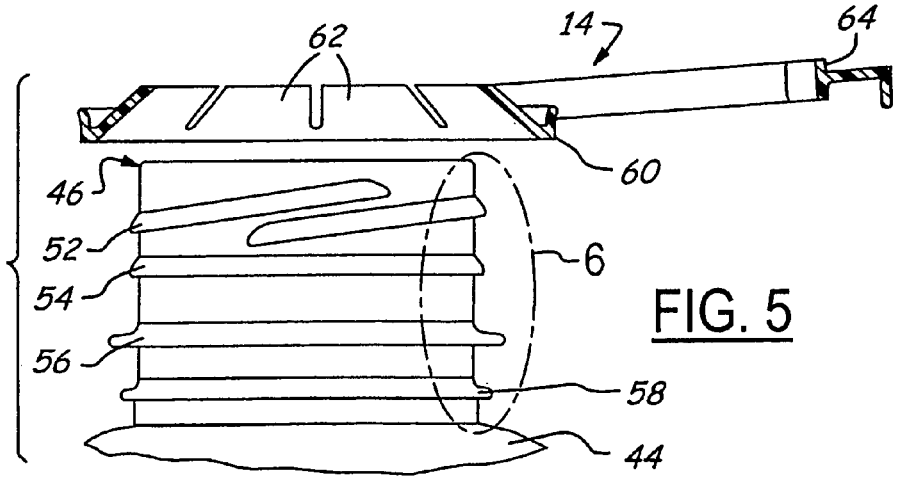
FIG. 5 is a fragmentary exploded elevational view that illustrates the bale handle removed from the container finish in FIG. 1.
Figure 6:
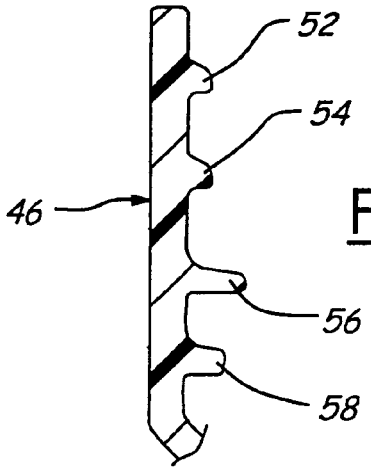
FIG. 6 is a fragmentary sectional view of the portion of FIG. 5 within the area 6.

Referring in particular to FIGS. 5 and 6, container finish 46 is of cylindrical geometry, and includes one or more external threads 52 for securement of a closure to the finish. An A bead 54 extends circumferentially around finish 46 at a position beneath thread 52 for cooperation with tamper-indicating means on the closure. Such tamper-indicating means are illustrated, for example, in U.S. Pat. Nos. 4,984,703 and Re 33,265, the disclosures of which are incorporated herein by reference. An external support flange 56 extends circumferentially around finish 46 at a position beneath bead 54. A second external flange 58 extends circumferentially around finish 46 at a position spaced beneath flange 56. The undersurfaces of flanges 56, 58 lie in planes that are parallel to each other and perpendicular to the central axis of finish 46. As best seen in FIGS. 5 and 6, the outside diameter of upper flange 56 is greater than the outside diameter of lower flange 58. In one presently preferred implementation of the invention on a 48 mm finish, flange 56 has a nominal external diameter of 2.100 inches and flange 58 has a nominal external diameter of 1.980 inches. The axial spacing between the undersurfaces of flanges 56, 58 in this embodiment of the invention is 0.236 inch.

Figure 7:
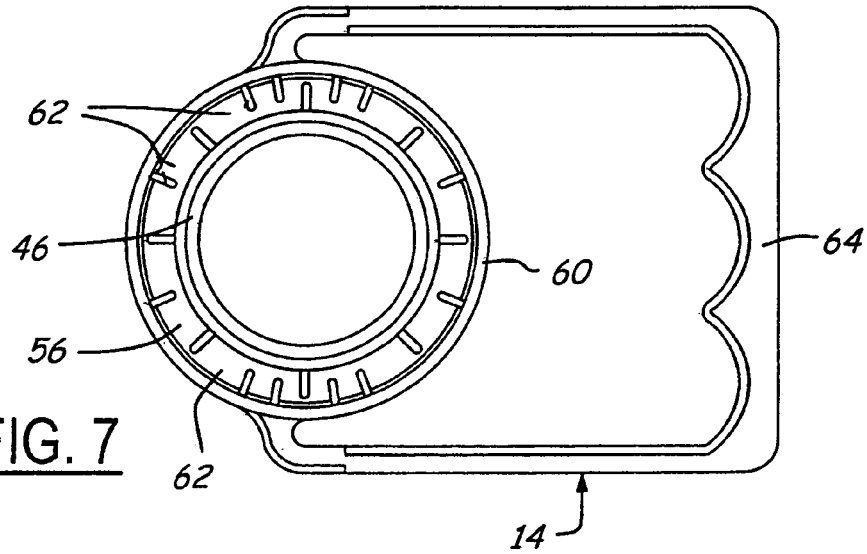
FIG. 7 is a top plan view of the bale handle secured to the container finish.

Bale handle 14 (FIGS. 1, 5 and 7) includes a circumferentially continuous annular ring 60 having a plurality of angulated flexible tabs 62 projecting radially inwardly therefrom. A handle 64 is externally secured to ring 60 and extends outwardly from the ring for positioning over shoulder 44, as best seen in FIG. 1. Ring 60 and tabs 62 are dimensioned and oriented so that the ring may be axially pushed over the external surface features of finish 46 until tabs 62 are disposed beneath lower flange 58. Ring 60 and handle 14 are thus captured beneath flange 58 between the undersurface of the flange and the upper outer surface of container shoulder 44. Tabs 62 of bale handle engage an undersurface of flange 58, at least when the bale handle is used for carrying the container. Bale handle 14 is thus captured in assembly beneath lower flange 58, leaving the undersurface of upper flange 56 unobstructed and free for performing guide and/or support functions during further processing of container 10—e.g., during filling, capping, labeling and boxing of the container.

Figure 8:
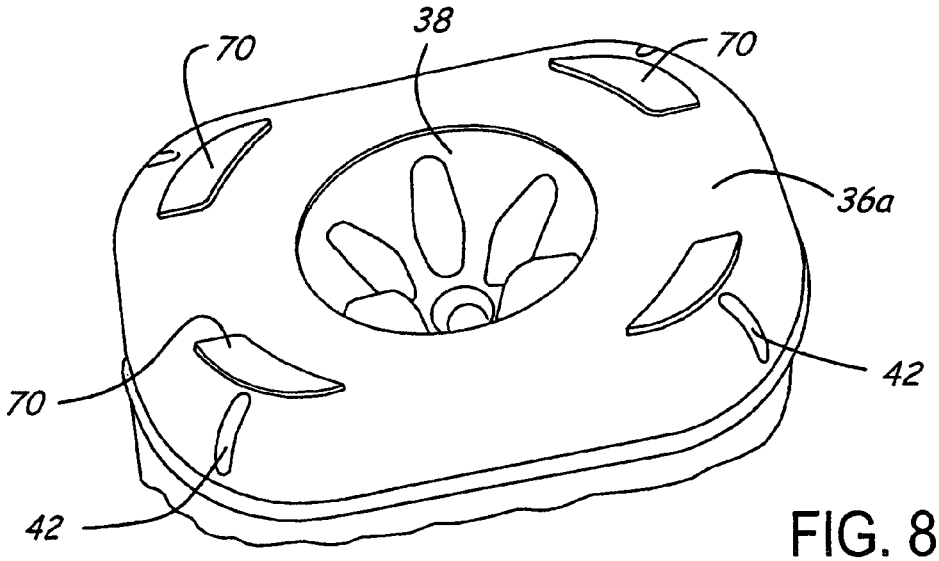
FIGS. 8 and 9 are fragmentary perspective views of the container bottom in accordance with modified embodiments of the invention.
Figure 9:
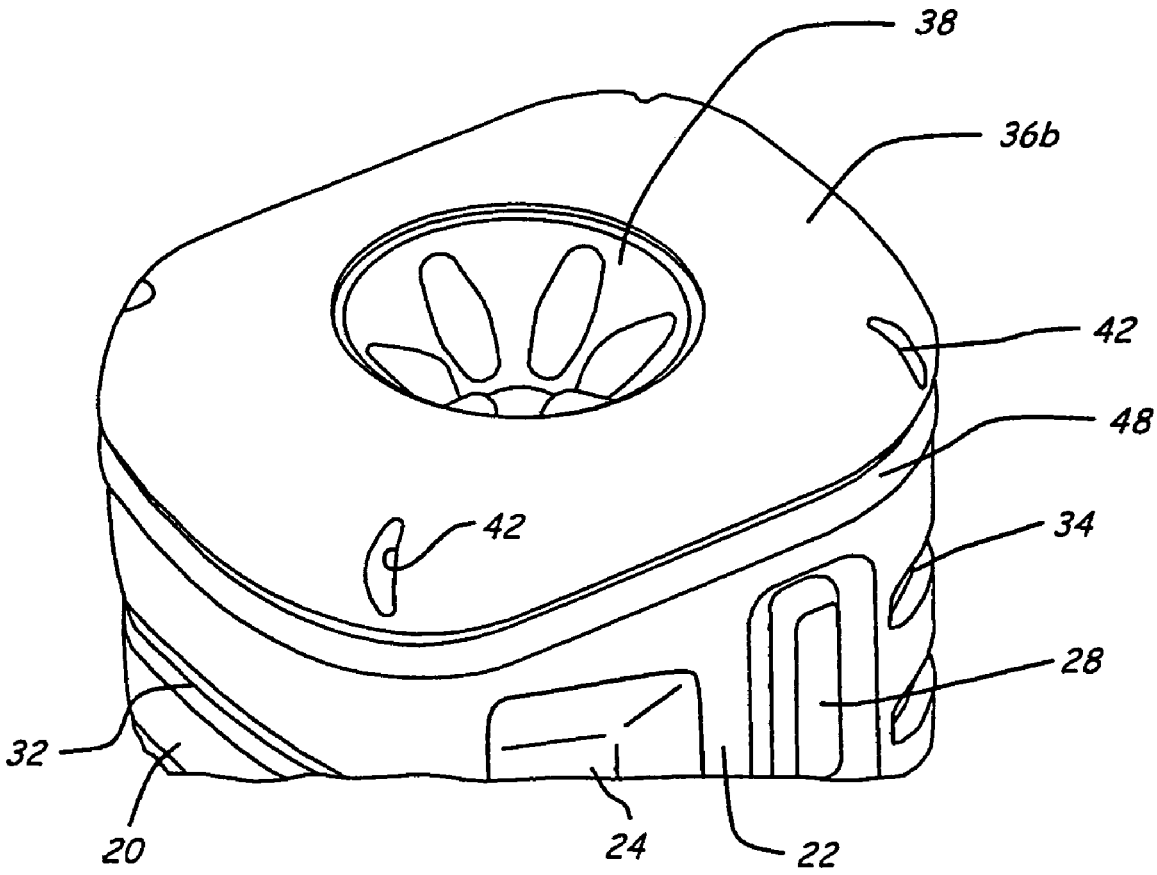

FIGS. 8 and 9 illustrate modified embodiments of container bottom wall 36. In FIG. 8, bottom wall 36*a* has upstanding feet 70 disposed at each corner of the bottom wall. FIG. 9 illustrates an embodiment in which the feet form part of the outer surface of bottom wall 36*b*.

There has thus been disclosed a container that fully satisfies all of the objects and aims previously set forth. The container has been disclosed in conjunction with three presently preferred embodiments thereof, and other modifications and variations have been described. Further modifications and variations will readily suggest themselves to persons of ordinary skill in the art. The invention is intended to embrace all such modifications and variations as fall within the spirit and broad scope of the appended claims.

The invention claimed is:

1. A hot-fill container comprising:

a rectangular body having a front wall, a back wall, opposed sidewalls each having a handle area and a pair of axially spaced flexible hot-fill panels, and a bottom wall, a shoulder extending upwardly from said body, said back wall having strengthening channels that extend between said handle areas, said front wall having strengthening channels that extend between and into said sidewalls, a pair of spaced channels that extend entirely around said body between said panels, and said bottom wall and said shoulder respectively, and one of said channels on said front wall extending into said sidewalls between said pair of hot-fill panels.

2. The container of claim 1, wherein the container has a capacity of at least one-gallon.

3. The container of claim 1, wherein said bottom wall has a central push-up feature.

4. The container of claim 1, wherein said handle areas are recessed and adjacent to said back wall.

5. The container of claim 1, wherein said bottom wall has feet at each of its corners, and wherein each foot has a strengthening channel at the associated corner of said bottom wall.

6. A hot-fill container comprising a rectangular body and a finish, said rectangular body having a front wall, a back wall, opposed sidewalls and a bottom wall, said opposed sidewalls each having a pair of axially spaced hot-fill panels adjacent to said front wall, wherein each sidewall has a handle area and said back wall has strengthening channels that extend between said handle areas, said front wall has strengthening channels that extend between and into said sidewalls, and a shoulder extending upwardly from said body, and wherein said body has a pair of spaced channels that extend entirely around said body between said panels and said bottom wall and said shoulder respectively.

7. The container of claim 6, wherein the container has a capacity of at least one-gallon.

8. The container of claim 6, wherein said bottom wall has a central push-up feature.

9. The container of claim 6, wherein said bottom wall has feet at each of its corners, and wherein each foot has a strengthening channel at the associated corner of said bottom wall.

10. The container of claim 6, wherein said finish has an open end, at least one external thread beneath said open end, an external bead beneath said at least one thread for cooperating with tamper-indicating means on a closure secured to said finish, and a pair of spaced circumferential flanges beneath said bead.

11. The container of claim 10, wherein said spaced circumferential flanges include an upper flange and a lower flange, said upper flange having a greater external diameter than said lower flange.

12. The container of claim 10, wherein said spaced circumferential flanges include an upper flange and a lower flange, each flange having an undersurface.

13. The container of claim 12, further comprising a bale handle captured on the undersurface of said lower flange.

14. The container of claim 13, wherein the bale handle includes a ring having resilient internal tabs captured on the undersurface of said lower flange, and a handle extending from the ring for carrying the container.

15. The container of claim 12, wherein the undersurface of the upper flange is free of obstruction.

* * * * *